US006948648B2

(12) United States Patent
Armstrong et al.

(10) Patent No.: US 6,948,648 B2
(45) Date of Patent: Sep. 27, 2005

(54) MISTING MANIFOLD APPARATUS AND METHOD OF MANUFACTURE

(75) Inventors: Neal N. Armstrong, Cathedral City, CA (US); Allen A. Jones, Redlands, CA (US)

(73) Assignee: Hydro Fog, Inc., Redlands, CA (US)

( * ) Notice: Subject to any disclaimer, the term of this patent is extended or adjusted under 35 U.S.C. 154(b) by 36 days.

(21) Appl. No.: 10/659,718

(22) Filed: Sep. 10, 2003

(65) Prior Publication Data

US 2004/0121660 A1 Jun. 24, 2004

Related U.S. Application Data

(60) Provisional application No. 60/415,540, filed on Oct. 1, 2002.

(51) Int. Cl.[7] ..... B21D 39/04

(52) U.S. Cl. ..... 228/131; 219/61; 239/434

(58) Field of Search ..... 228/131, 165, 228/173.5; 239/8, 432, 433, 434, 568, 600; 219/61, 60 A

(56) References Cited

U.S. PATENT DOCUMENTS

| | | | | |
|---|---|---|---|---|
| 3,478,843 A | * | 11/1969 | Eckardt | 184/6.26 |
| 4,591,099 A | * | 5/1986 | Emory et al. | 239/419 |
| 5,421,522 A | * | 6/1995 | Bowen | 239/600 |
| 6,098,896 A | * | 8/2000 | Haruch | 239/8 |
| 6,793,148 B2 | * | 9/2004 | Ratnik | 239/2.2 |

* cited by examiner

*Primary Examiner*—Jonathan Johnson
(74) *Attorney, Agent, or Firm*—Philip H. Haymond

(57) ABSTRACT

A method and apparatus for a constructing misting manifold is disclosed that uses a standardized intermediate member joined to tubing. The method allows mass production, particularly with use of orbital welding, easy alignment of the component part and high quality welds.

20 Claims, 7 Drawing Sheets

MISTING MANIFOLD APPARATUS AND METHOD OF MANUFACTURE

CROSS REFERENCE TO RELATED APPLICATION

This patent application claims priority to U.S. Provisional Patent Application No. 60/415,540 filed on Oct. 1, 2002, entitled Misting Manifold Apparatus and Method.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

This invention pertains to high pressure delivery liquid systems made of tubing for the transport of liquids, and more particularly to a method and a manifold for transporting liquids at high pressure to supply nozzles for fog, mist or spray production, referred herein to as a misting manifold. This invention also pertains to a more efficient method and system for welding a metallic tubing manifold for liquid transport, the embodiments of the present invention disclosed pertaining to tubing of the sort typically used for misting or atomization manifold systems, thereby more efficiently and economically producing tube manifold having superior joints.

2. Description of Related Art

Misting systems are widely used, they are systems that produce a stream of ultra-fine aerosol-sized droplets of water or other liquids when a mist or a fog is desired. Misting systems are used to keep objects cool or moist, objects such as vegetable produce and, in recent years, misting systems have become more popular for cooling people or animals. Misting systems are also used for theatrical effects to produce fog. The ultra-fine water droplets produced by emitters are introduced into the air where they flash evaporate, dissipating heat and resulting in the cooling of an object. Misting systems used to cool or humidify ambient air are frequently supplemented with a fan or other device to move the misted air about. Such systems may be employed to control environmental conditions in greenhouses, cold storage, outdoor cooling, special effects as well as dust and fire suppression.

Misting systems require that the water or other liquid be forced thorough a specialized nozzle known as an emitter at very high pressure, in a range of about 1,00–3,000 p.s.i., for atomization. The higher pressures are used particularly when ultra fine droplets are required to atomize the water to produce a fog. In general, emitters are attached to a manifold of suitable tubing and liquid is pumped through the tubing to carry the liquid to the emitters to produce the mist or fog. Stainless steel is typically preferred in the manufacture of such systems to prevent corrosion by the liquid, water or salts carried by the liquid.

In the prior art such a manifold might be constructed by providing a length of stainless steel tubing joined to riser. The riser, also made from stainless steel, might be prepared from a billet or from rod stock, as shown in FIGS. 1A–1D. A length of stainless steel tubing 21 of 0.375" outside diameter, 0.305" inside diameter and with a wall thickness of about 0.035" could be used and a hole 22 drilled in the wall of the tube to receive a riser. The riser 23 might also be made from stainless steel and is prepared, shown in FIG. 1B, from a billet or rod stock. The billet is milled to provide a saddle-shaped end 24 to conform to the shape of the tube and a channel or bore 25 is drilled through the axis of the riser; the might additionally be threaded to receive an emitter. The riser channel 25 is then aligned with the hole 22 in the tube and then affixed (in direction of arrow) to the tube with a saddle weld, as shown in FIG. 1D. The hole in the tubing 22 might alternatively be drilled after the welding process, through the riser channel 25, and then through the tube after it is welded to the riser. In either case the hole 22 formed in the tubing wall allows liquid communication between the tubing and the riser channel.

The length of tubing used depends on the specific misting manifold desired. Typically many risers are used in the system and this exercise must be repeated to complete the system. An emitter 99 is screwed into (shown by arrow) the threaded riser channel 25 of each riser.

This construction and method has many disadvantages. The existing process is expensive, time-consuming, difficult to automate and ill-designed to being adapted to use with an orbital welder. Furthermore the existing process usually requires that the welds be made in an uncontained gas environment or even ambient air. An uncontained gas environment using inert gas is one where the welding area is simply flooded with inert gas, allowing lessened but occasional contact with the oxygen from the air. Orbital welding in contrast may be performed in a contained inert gas environment to confine the inert gas. For example, in the Gas Tungsten Arc Welding (GTAW) orbital welding process any inert gas used is contained within the clamshell of the orbital welder and the pieces are welded without contact with oxygen. GTAW is also referred to as TIG (tungsten inert gas) welding.

Moreover, when this prior art method is employed the relative masses of the walls of the riser and the tubing may cause a less desirous weld. The riser is made from stock and must have walls of sufficient thickness to support the emitter. The tubing may have walls that are not as massive and the mass of the riser and the tubing are therefore disproportionate. This disproportionate mass of the parts results in differential heating of the parts during the welding process. Because the riser must be sufficiently heated to weld, the tubing therefore becomes overheated. Excessive heating of the tubing causes deterioration of the metallurgical and structural properties of the tubing, apparently this overheating damages the chemical and structural integrity of stainless steel, rendering it significantly more susceptible to corrosion. The resulting corrosion may in turn lead to clogging of the emitters with corrosion byproducts. Together overheating and contamination by oxygen and associated oxidizing elements during the welding process leads to early corrosion and deterioration of the welded material.

As noted above, each riser must be cut from stock and a saddle shape ground in one end and further be drilled and tapped to receive an emitter. Another drawback to this prior art method is that when more than one riser is placed on a length of tube it is difficult to position the plurality of risers in relative alignment to one another.

It would be advantageous then to manufacture a misting manifold apparatus that is amenable to welding in a contained gas environment, such as with a GTAW/TIG orbital welder, automatedly producing a consistently stronger weld with few contaminants from oxygen. It would also be advantageous to use a construction method an apparatus that joins parts at junctures where the mass of the two parts is similar, to prevent differential heating of the two parts. It would also be advantageous to have a system where individual risers can be more easily relatively aligned when used with the orbital welder.

SUMMARY OF THE INVENTION

In one aspect the invention encompasses providing a method and system for the manufacture of misting manifold, as well as a unique misting manifold component. The inefficiencies of prior art misting system construction are avoided by first producing an intermediate member, in place of the prior art riser construction, to receive one or more emitters and to be joined to the tubing. One or more intermediate members are joined to tubing to create a misting manifold. This method allows a butt or filet weld to be used, both welds being more amenable to use with the GTAW/TIG welding of the automated orbital welder. This method and construction also allows for a more accurate construction and positioning of the intermediate members.

The manifold for misting apparatus is made from one or more intermediate members or units and each intermediate unit has one or more shoulders forming the end of an axial channel in the intermediate member. Each intermediate member further has one or more branch channels in liquid communication with the axial channel and thereby adapted to be supplied by liquid introduced into the axial channel. The branch channels are further adapted to receive emitters to complete the construction.

The shoulders of each intermediate member are joined to tubing by welding. Each shoulder is may be joined to tubing, preferably having substantially the same shape and wall thickness as the shoulder to ensure that both pieces are of about the same heat capacity. Depending on the method of fabrication, the shoulder and tubing may have equivalent outside diameters. Alternatively the outside diameter of the tubing may be slightly less than the inside diameter of the shoulder, the diameter of the axial channel, so that the tubing fits within the axial channel, either extending partially into the axial channel or completely through the length of the axial channel. Alternatively the inside diameter of the shoulder may be countersunk to allow the tubing to fit just within the axial channel, without extending further through the length of the axial channel. In all cases it is preferred that wall thickness of the shoulder and that of the selected tubing be matched to achieve equivalent heat capacities of the tubing and the shoulder. This equivalent heat capacity of the two shoulders and the tubing allows for equal heating of both parts, resulting in an equal weld to both parts and avoiding damage from differential deformation or overheating of one of the two parts.

Each intermediate member has at least one face, which is a surface suitable for receiving an emitter oriented at an angle to the axial channel. The face need not necessarily be a flat surface but is shown in this disclosure as such for illustrative purposes. The branch channel is formed between the axial channel and the face to allow liquid communication between the axial channel and the branch channel. An emitter is attached to each branch channel of the misting manifold, except for when the user desires to simply block the branch channel with a plug or insert an extender device into a branch channel, which depends on the specific configuration of the system desired by the user for a particular installation.

The methods and designs of the present invention do not specifically require that the face formed for receiving an emitter be flat. It is generally preferred, however, that the surface of the intermediate member that is suitable for receiving an emitter be a substantially flattened face formed on the intermediate member. In the preferred embodiment there are six flattened faces of equal size provided in the hex-shaped member and the surface of each face is parallel to the direction of the axial channel, providing a surface that will hold an emitter perpendicular to the tubing.

A misting manifold will typically have a plurality of intermediate members commonly joined with tubing with each of the intermediate members joined at both of their shoulders, to allow liquid communication among the tubing, the axial channel and the one or more branch channels of each intermediate member. In some applications, however, an intermediate member will be fabricated having a single shoulder so that liquid communication with the tubing will occur through only a single side of the intermediate member and its one or more branch channels. Such an intermediate member with a single shoulder may be used to terminate a typical system at one or both ends. Other variations are possible too, such as an intermediate member with a single shoulder and having the side of the intermediate member distal the single shoulder closed, or having an additional branch channel located within the closure.

The intermediate member of the preferred embodiment may be fabricated by obtaining a length of stainless steel hexagonal bar stock. It is preferred that the intermediate member and the tubing are both composed of stainless steel to resist corrosion. In this embodiment the central axial channel is then drilled through the length of stock, parallel to and central to the six hexagonal sides. With respect to the preferred exemplary embodiment, the cut length of hexagonal stock is further lathe cut (hogged out) around the axial channel, at one or both ends of the axial channel, to produce one or more cylindrically shaped shoulders on the intermediate member. A branch channel is further drilled from one or more of the six hexagonal faces, through to the axial channel. Each branch channel is further threaded to receive an emitter. This embodiment of the intermediate member is herein referred to as a hex member.

Other configurations may be useful for specific situations, however. For example solid round rod may be used if desired and then portions of it removed to achieve a desired cross-sectional shape. The circumference of the length of round rod stock may, for example, be ground to produce four flat sides with rounded edges, producing a central or even offset axial channel. Such a offset configuration is herein termed a tombstone intermediate member, and is particularly useful to allow an intermediate member to be installed in an area having limited space. Intermediate members of different configurations may be used together in the same misting manifold.

In any case the outer surface of the stock is fabricated to have one or more faces, which is a surface suitable for receiving an emitter. A branch channel is formed, by drilling for example, extending between the face and the axial channel and is further prepared to receive an emitter, for example by threading the branch channel. A face need not necessarily be flat but, for illustrative purposes, the six flat sides of the above hex member embodiment may each serve as a face. The four flat sides of the above tombstone intermediate member embodiment may likewise serve as faces. In the case of the tombstone intermediate member, which is designed to conserve space, a branch channel between a face and the axial channel is formed on the face distal the offset axial channel, to allow the side opposite the distal side to take the least room when abutted against a wall upon installation.

A misting manifold is then assembled with hex members welded to each other with tubing, in a first embodiment tubing is selected such that the intermediate member will fit snugly fit over the tubing. The intermediate members are slipped over the length of tubing, moved to their desired position along the tubing. In this embodiment the shoulder of each intermediate member is welded as a socket joint that is filet welded to the tubing with an orbital welder, preferably by TIG welding. A hole in the tubing is then tapped through each branch channel to pierce the tubing sufficient to allow fluid communication between the tubing and the branch channel. Each branch channel of the misting manifold is then fitted with an emitter to complete the manifold.

In a second embodiment two intermediate members are joined with tubing segments that extend therebetween. This embodiment may be combined with the first embodiment of joining intermediate members to tubing to create a misting manifold. With this second embodiment the shoulder may be formed to incorporate an annular step in the shoulder, the shoulder is countersunk, to serve as a stop to receive the tubing. The tubing in this embodiment is best not inserted into the intermediate member so far as to interfere with the communication of liquid between the branch channel and the axial channel, countersinking the shoulder will prevent this. In this way the insertion depth of the tubing can be predetermined and only partially inserted within the axial channel and then socket welded in place with TIG orbital welding. With this construction there is therefore no need for the step of puncturing the tubing through the branch channel to allow liquid communication, because the tubing does not extend through the intermediate member.

A third embodiment and method of construction uses tubing selected to be of equal diameter as that of the shoulder of the intermediate member. The tubing selected is again of substantially the same heat capacity sad the shoulder, but this should be approximately correct if both the tubing and the shoulder are of the same size and made of the same stainless steel material. The ends of the shoulder and the tubing are butt welded together. This system may also be used when welding the shoulder of an intermediate member directly to the shoulder of a second intermediate member.

This second and third embodiments and methods may be preferable when there is a surplus of shorter tubing segments to be used to build a manifold, or where the tubing is difficult to puncture to connect the axial channel to a branch channel.

Emitters are fitted within the branch channels. Emitters of various constructions and capacities, well known in the art may be used, depending on the spray pattern desired. Some emitters are designed to produce mist, others to produce fog. The system may be further extended by use of a flexible conduit have an extender between the intermediate member and the emitter. In this manner misting manifold of any design may be efficiently and economically created by use of an automated orbital welder in a standardized manner to achieve consistent welds and exact angles in a misting manifold. An emitter extender may be used, that is inserted into a branch channel. The emitter extender consists of a male portion affixed to a branch channel and a female end adapted to receive an emitter.

The design of a complete misting manifold is specific to the desired application, each manifold being custom designed for the area desired to be misted or fogged. After the configuration of the desired misting pattern is ascertained, a suitable combination of tubing, intermediate members and tubing is selected to assemble a suitable misting manifold that will result in the desired misting pattern.

The number and positioning of the flattened surfaces and location of the axial channel on the intermediate member are specific to the application. The intermediate member may have one or more flattened surfaces to allow receive and securely seat an emitter, and the axial channel may be centrally located or offset from center. The flattened face formed to receive an emitter may further be parallel to the direction of the axial channel/tubing or it may be formed at an oblique angle. The intermediate member may include a single surface, as in a tombstone type of intermediate member, or may include a multiplicity of surfaces. In the preferred embodiment for general use there are six equal surfaces provided surrounding a central axial channel to form a hex member. This shape allows for easy positioning of the emitters because the user can select a standard misting pattern in conjunction with the standard regularly spaced faces of the intermediate member. Emitters designed to produce a sixty degree mist pattern, for example, can be used with a hex shaped intermediate member to produce portions or all of a three hundred and sixty degree misting pattern. Each face, for example, may be equipped with an emitter having a sixty degree spray pattern to collectively achieve a three hundred and sixty degree spray pattern.

The method for manufacturing a misting manifold includes the step of providing tubing and one or more intermediate members. Each intermediate member has one or more shoulders and also includes one or more faces suitable for receiving an emitter at an angle to the axial channel, in the preferred embodiment an angle of ninety degrees to the axial channel. A branch channel extends between the axial channel and the face, the branch channel is usually also threaded to receive an emitter.

Each of the one or more intermediate members are then positioned or aligned on the tubing relative the other intermediate members. The tubing is then joined to the tubing at a shoulder of one or more intermediate members and the tubing. Each intermediate member is joined on at least one shoulder to allow liquid communication between the tubing and the axial channel of each intermediate member. The intermediate members may be either joined to the tubing by individually butt welding each intermediate to a segment of tubing, or, may be first positioned along a length of tubing, socket welded to the length of tubing, then the tubing is punctured through the branch channel to complete liquid communication between the branch channel and the axial channel. Emitters are then affixed to the branch channels to compete the misting manifold.

In the preferred embodiment of the method a hex-shaped and stainless steel intermediate member is used, having six equal flattened faces parallel to an axial channel. The axial channel is centrally located. In the preferred embodiment the axial channel has an inside diameter that just slightly exceeds that of selected tubing and the hex shaped members are slipped over a length of tubing and positioned at their desired locations and orientations. One or more faces of each hex-shaped member are bored and threaded to create a branch channel and to receive an emitter. The intermediate members may be held in position with a set screw that fits into the branch channel. The shoulders of each intermediate member are then joined to the tubing with TIG orbital welder. The set screw is then removed and the tubing is tapped through each branch channel to allow liquid communication between the tubing and the branch channels. Finally, an emitter is fitted into each branch channel.

BRIEF DESCRIPTION OF THE DRAWINGS

FIGS. 1C and 1D are exploded views of assembly.

DETAILED DESCRIPTION

The following detailed description, and the figures to which it refers, are provided for the purpose of describing example(s) and specific embodiment(s) of the invention only and are not intended to exhaustively describe all possible examples and embodiments of the invention. In the following various figures identical elements and features are given the same reference number, and similar or corresponding elements and features are or may be given the same reference numbers followed by an a, b, c, and so on as appropriate for purposes of describing the various embodiments of the present invention.

The preferred embodiment for an intermediate member and for the misting manifold of the present invention intermediate member depends on the desired application, the shape and requirements for a misting or fogging system. A variety of differently shaped intermediate members may be used, but a hex member is shown here as an illustrative example as well a good shape for a general purpose intermediate member.

Figure 1A:
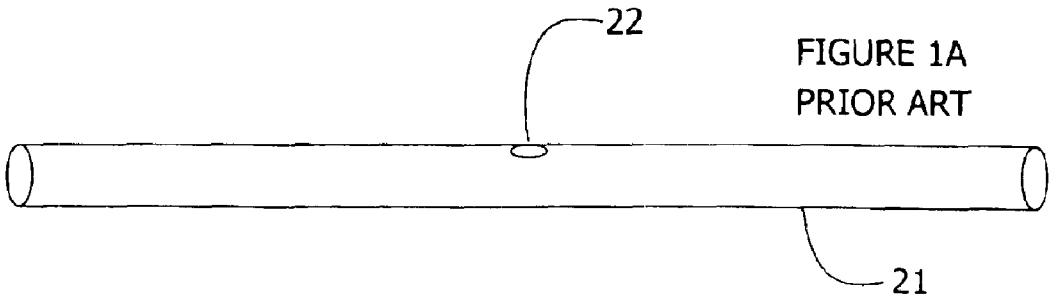
FIGURE 1A PRIOR ART
FIGS. 1A–D are side plan views of a misting manifold constructed according to the method of the prior art.
Figure 1B:
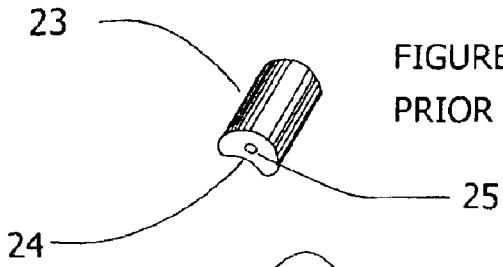
FIGURE 1B PRIOR ART
Figure 1C:
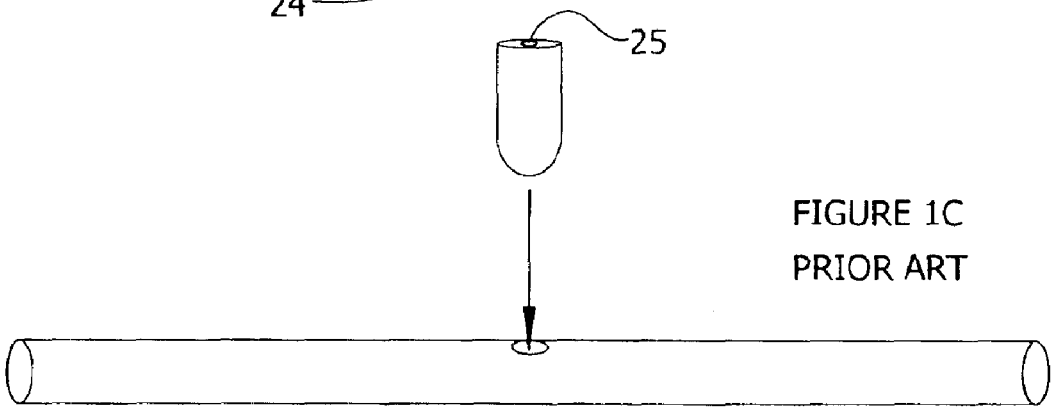
FIGURE 1C PRIOR ART
Figure 1D:
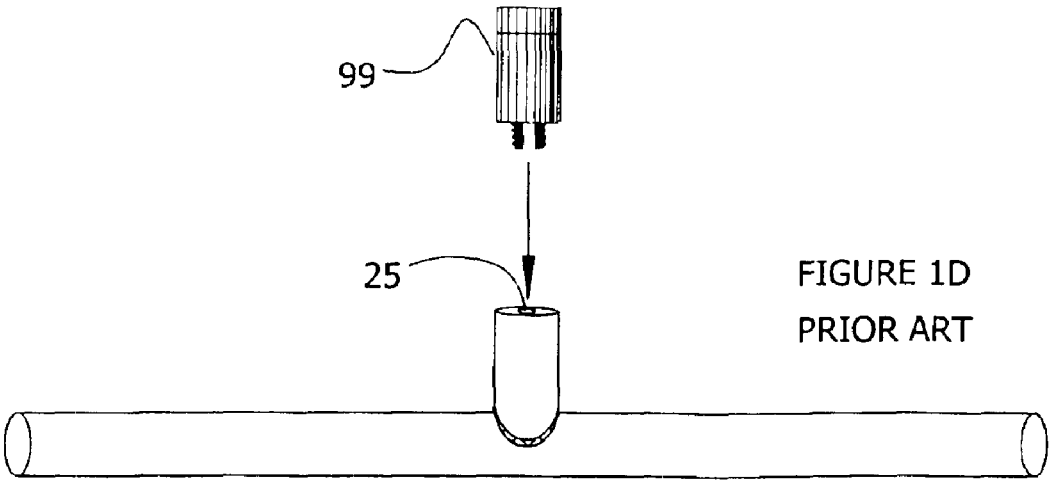
FIGURE 1D PRIOR ART
Figure 2A:
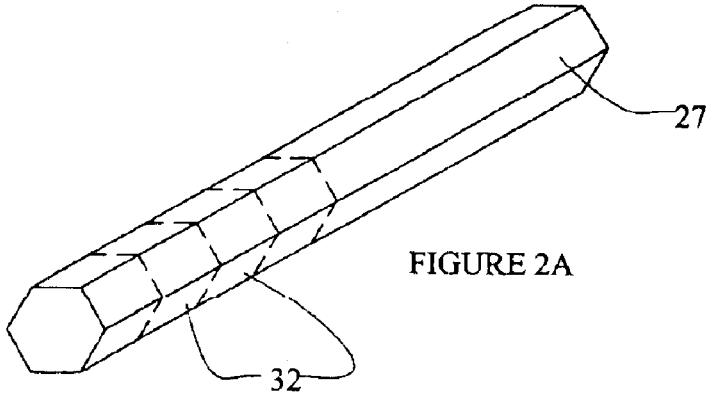
FIG. 2A is a perspective view of a length of hexagonal rod from which the intermediate members are produced.
Figure 2B:
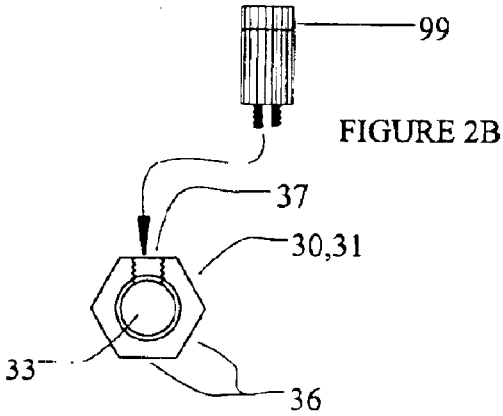
FIG. 2B is a partial cutaway side view of a hex member used to join lengths of tube.
Figure 2C:
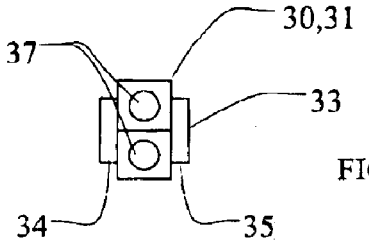
FIG. 2C is an front view of a hex member used to join lengths of tube.

Referring now to FIGS. 2A–2C an intermediate member 30 is produced by cutting sections from a length of stainless steel bar stock 27, in this example hexagonal-shaped stainless steel bar stock 27, at intervals to produce stock pieces 32 (at dotted lines) for making individual hex members 31. Each stock piece 32 is bored to produce an axial channel 33. In this embodiment the axial channel 33 is bored centrally through the major longitudinal axis. The intermediate member 30 is formed by grinding or hogging on one or both longitudinal sides of the stock piece 32 to produce first and second shoulders 34 and 35 respectively about the axial channel. The shoulders 34 and 35 of the intermediate member 30 in this and other embodiments, here a hex member 31, aid in orbital welding by allowing the weld to occur without cross-arcing onto the non-shoulder portion of the intermediate member. Each intermediate member 30 has one or more faces 36, in the case of the hex member 31 there may conveniently be six faces. A branch channel 37 is bored in one or more of the faces (shown in cutaway in FIG. 2B) of the intermediate member to allow liquid communication with the axial channel 33. The branch channels 37 may then be threaded to receive an emitter 99 (inserted at arrow).

Figure 3A:
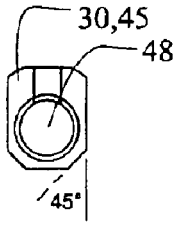
FIG. 3A is a side view of a tombstone member.
Figure 3B:
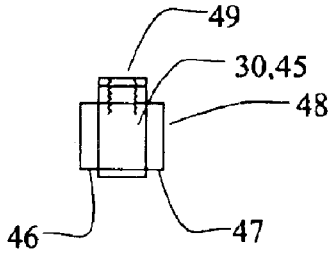
FIG. 3B is an front view of a tombstone member.

Intermediate members of other shapes may be constructed as needed. For example, FIGS. 3*a* and 3*b* show side and front views of a tombstone intermediate member 45. This is an example of an intermediate member having four sides ground from solid round rod, the sides have been ground to produce four flat sides with rounded edges. The shoulders 46 and 47 and axial channel 48 are offset from the center of the stock, having a relatively long branch channel 49 leading to a face distal the shoulders. This configuration is particularly useful to allow an intermediate member to be installed in an area having limited space, adjacent a wall or another parallel length of tubing, while allowing the face, and therefore an emitter (not shown), to extend outwardly. Intermediate members of different configurations may be used together in the same misting manifold.

Figure 4A:
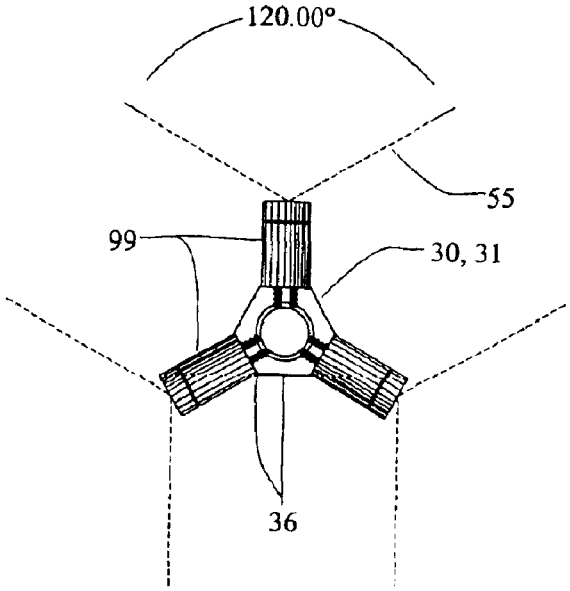
FIG. 4A is an side view of a hex member, wherein a plurality of emitters have been threadably joined to the intermediate member.
Figure 4B:
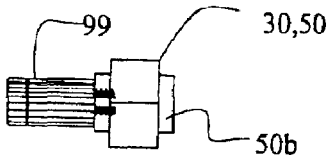
FIG. 4B is a side view of a hex member, having a single shoulder and an emitter placed distal the shoulder.

Referring now to FIGS. 4A and 4B one or more emitters may be joined to each intermediate member 30. The hex member 31 shown in FIG. 4A has three emitters 99, one each placed on three adjacent flat sides, faces 36, of the six flat sides of the hex member. For illustration purposes the three emitters used each have about a one hundred and twenty-degree spray pattern (dotted lines 55) which together produce a 360 degree spray pattern. All six faces could be provided with branch channels and sixty-degree emitters, producing a 360 degree spray pattern around the hex member. A hex intermediate member 50 of the alternative embodiment of FIG. 4B has a single shoulder 50*b*. The opposite or distal side of the intermediate member is plugged to provide a face, and further provided with a branch channel and an emitter. This embodiment might be useful as an intermediate member that terminates a misting manifold.

Figure 5A:
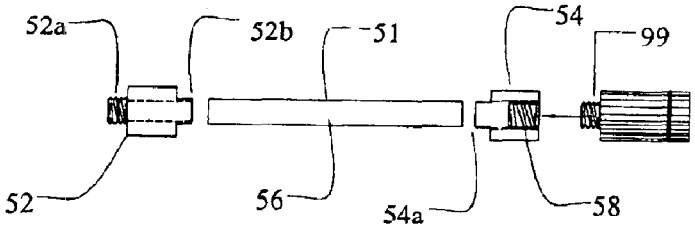
FIG. 5A is a cutaway exploded side view of an emitter extender that may be used with the systems of the present invention.

An extender for holding an emitter may be required in some situations, where there is an interfering obstruction such as a roof overhang that might block the misting pattern for example. FIG. 5A is a cutaway side view of an emitter extender 51 that may be used with the systems of the present invention. An emitter extender 51 is useful to redirect a branch channel without moving an existing manifold, or may be easier to employ rather than bending the tubing itself while initially constructing the misting manifold prior to installation.

Figure 5B:
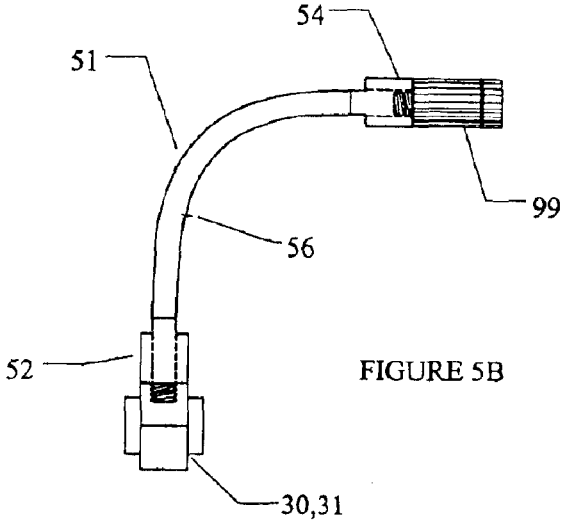
FIG. 5B is a side view of extender mounted in the branch channel of a hex member.

Referring now to FIGS. 5A–5B, an emitter extender 51 is constructed much like two intermediate members joined by tubing having one or more shoulders but without any branch channels. An emitter extender 51 is made of two extender portions or ends, here a male portion 52 and a female portion 54, connected with tubing 56 such that an extender axial channel 58 extends through the length of the three components. The two extender ends 52, 54 are preferably joined with stainless steel tubing 56 with a butt weld, but a filet weld (44 in FIGS. 9A, 10) for a socket joint will work too. In this embodiment the male portion 52 has two shoulders 52*a* and 52*b*. One shoulder 52*a* is externally threaded to join to the branch channel of an intermediate member, the other shoulder 52*b* is welded to the tubing 56. The female extender portion 54 has a single shoulder 54*a* that is welded around the tubing 56 and the axial channel 58 of the other end 54*b* is internally threaded to receive the external threads of an emitter (shown with arrow). The emitter extender is therefore adapted to be joined to a branch channel of an intermediate member so that there is liquid communication between the branch channel and the extender axial channel. Although the extender ends 52, 54 in this embodiment are male and female, it is foreseeable that two male portions or two female portions might be used for a given application, in either case the tube 56 is connected at a shoulder of an end. FIG. 5B is a side view of extender mounted in the branch channel of a hex 31 intermediate member 30, note the tubing 56 may be bent for a given application.

A misting system is planned in the conventional manner that is familiar to those of skill in the art. The area to be misted or fogged is measured and the surface that will hold the misting manifold is likewise determined. The proper combination of tubing of suitable size and capacity, and emitters of suitable capacity and with suitable spray patterns are determined.

Figure 6A:
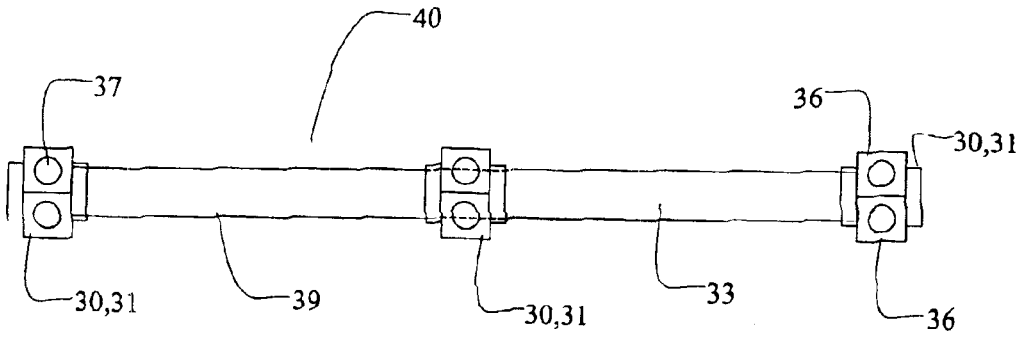
FIGS. 6A–6B are side plan views of a misting manifold with hex members constructed by positioning intermediate hex members on a continuous length of tubing and relatively aligning them, and joined by welding.

FIG. 6A shows a first method of construction, it is a schematic view of misting manifold 40 under construction with hex members 31, positioned along a continuous length of tubing 39 and relatively aligned according to the plan for a given misting manifold.

The hex members 31 are first positioned according to the desired plan for a misting manifold along the length of tubing 39 by slipping these intermediate members over the length of tubing. Typical dimensions used for a misting manifold include a shoulder having an outside diameter of 0.448" and an inside diameter of 0.378" leaving a wall thickness of about 0.35." The axial channel 33 is sized to have an inside diameter just larger than the outside diameter of the tubing 39, to within about 0.002". This process has proved to work with tubing and pipe sizes between ⅛" to 3" outside diameter and will likely be successful with other sizes as well. By way of example a hex-member 31 shoulder of 0.005"–0.120" in length may be used.

The branch channels 37 of the hex members 31 are then relatively positioned so that when the misting manifold 40 is placed and emitters are inserted into the branch channels 37 they will generate the desired spray pattern. The six regularly spaced sides that function as faces 36 of the hex member 31 may be used to facilitate alignment, because each face at a sixty degree angle to its neighbors. A benefit of using a hex-shaped intermediate member 31 is the ease of ascertaining the relative orientation of any two intermediate members. The surface angles of the hexagonal intermediate members 31 can be used by the manufacturer to easily align two intermediate members 31 relative to each other. Emitters 99 connected to different faces of each intermediate member, here hex members 31, will be aligned accordingly as well. This consistency aids the planning and use of emitters to project a desired spray pattern.

In the present invention, using a hexagonal intermediate member 31, the emitters 99 are always oriented at multiples of sixty degrees with respect to each other. Where intermediate members of any configuration have a plurality of faces at known angles, such as the hex member 31, this property can be used to help align intermediate member branch channels, hence emitters, relative each other. For example a hex member 31 having one branch 37 channel may be positioned on the tubing then placed on a flat surface, the branch channel of any second intermediate member placed over the same tubing (or tubing segments, below) may then be conveniently aligned with the hex member 31 by placing it on a common flat surface and rotating the hex member to a desired position at, sixty degree increments. Aligning the faces of the two intermediate members in this manner allows a quick estimation of whether the relevant faces are 60, 120, 180, etc. degrees in alignment and thereby streamlines the assembly process.

The hex members 31 may be held in position with a set screw 38 placed through branch channel 37 (shown by arrow) where the tubing 39 passes through the hex member. Each shoulder of each hex member 30 is then filet welded to the length of tubing with an orbital welder 41 in a contained inert gas environment. The stainless steel tubing 39 is further punctured through the branch channel 37 sufficient to allow substantially unimpeded liquid communication between the branch channel 37 and the axial channel 33 of the stainless steel tubing 39.

The misting manifold tubing 39 is preferably welded to each shoulder of the intermediate member by orbitally welding it in a contained inert gas (substantially anaerobic) atmosphere, usually using an inert gas such as Argon. It is further preferred that the tubing selected and the shoulder of the intermediate member are both sized so that the tubing and the shoulder have substantially the same heat capacity. In this manner the two parts are equally effected by heat when welded, preventing disproportionate welding effects to the tube to the and shoulder of the intermediate member.

Orbital welding for tubing refers to circumferential welding of tube-to-tube joints, to join lengths of tubing end to end, or tubes to fittings including flanges, elbows, branch connections in tubing systems, etc. While orbital welding can be performed manually, it is usually performed by mechanized equipment. Orbital welding can be performed with a number of welding processes, but by far the most common for tubular products in all metals and alloys. For tubular products welding is usually carried out without filler wire or solder addition to the weld pool. Although filler wire can be added by mechanized cold wire feed systems, it is not preferred in the present invention.

Figure 6B:
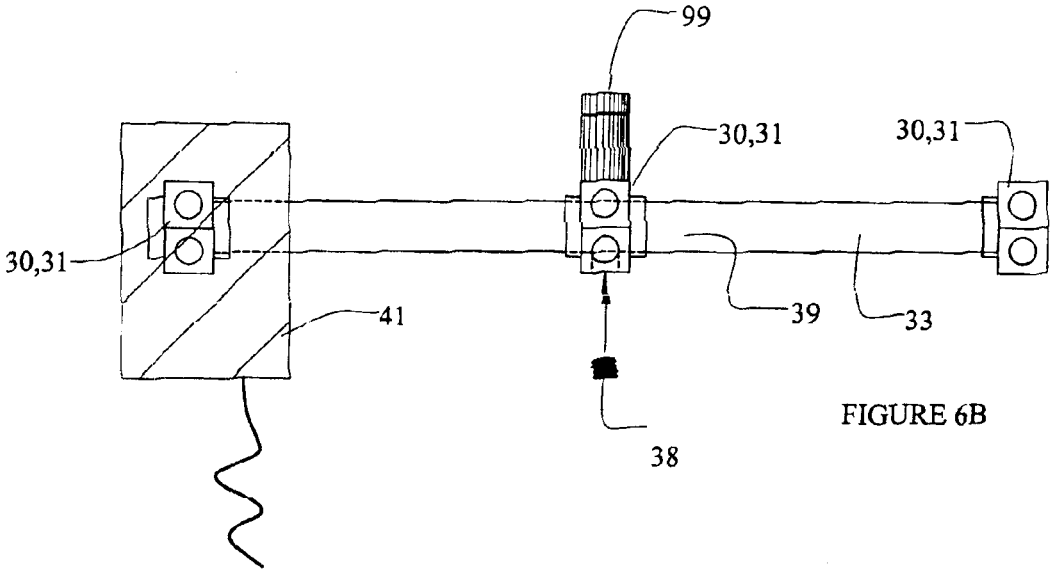

Equipment for orbitally welding tubing usually involves a clamp–on system for tube diameters from 0.125-in. through 6 to 8-in., shown in FIG. 6B and track mounted systems are used for larger diameters. The orbital welder 41 head design is either a U-shape or of a split clam-shell design to facilitate clamping to the fit-up tube joint. The head remains stationary while the electrode is rotated within the body of the welding head. Such systems maximize the consistency, quality and productivity of tube-to-tube butt welding operations and overlapping socket joint welding operations.

Orbital welding systems may be manual or computer controlled, with multiple segment programming for different welding positions around the fixed axis of the joint. The orbital weld produces a consistent weld with assured welding penetration about the intermediate member. An orbital weld produces a clean fusion weld, without the use of filler rod. Joining the intermediate members to the tube sections makes for practical use of an orbital welder because otherwise a jig or lathe is usually required to be used to move the tube. An orbital welder can also be programmed to perform this method by means of a computer, automating the process, resulting in further cost reduction and consistency in quality.

Emitters 99 are then threadably attached to the branch channels to complete the misting manifold, as shown in FIG. 6B. The hex-shaped intermediate member 31 of the illustrative embodiments may conveniently accommodate from one to as many as six individual emitters 99 on each face 36, but intermediate members of other shapes may be used and intermixed. Where space is at a premium at a given position in the design of the misting manifold, for example, an intermediate member having sufficient mass for receiving only a single emitter on a single side may be used, such as the tombstone intermediate member, described above. Different types of intermediate members may therefore be incorporated into the same misting manifold for a particular application.

Figure 7:
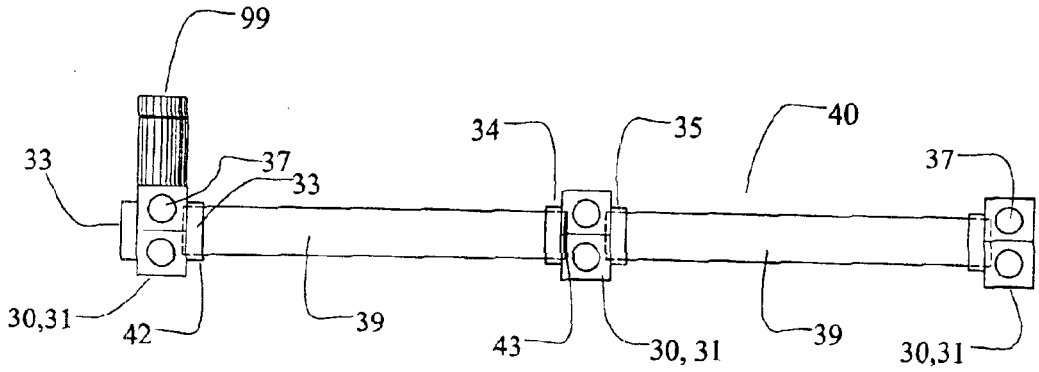
FIG. 7 is a plan view of a misting manifold of another construction, made from intermediate hex members and lengths of tubing by partially inserting the tubing within the shoulders, shown in cutaway views.

FIG. 7 is a schematic view of a misting manifold of another construction, made from hex members 31 and lengths of tubing 39 by partially inserting the tubing within the shoulders. This may be achieved by partially inserting tubing 39 into the axial channel 33 of the hex members 31, where inside diameter of the shoulders 34 and 35 are preferably sized to be just larger than the outside diameter of the tubing 39, to within about 0.002". Each intermediate member is joined on at least one side to allow liquid communication between the tubing the and the axial channel of each intermediate member.

The tubing is inserted into the axial channel 33 only to a depth that avoids occluding the branch channels 37. This may be prevented by including an annular step or groove 43 in the shoulders, 34, 35 and 42 to act as a stop on the tubing when it is inserted. The hex members 30 are positioned on the tubing by selecting tubing 39 segments of desired length, rather than by sliding the hex members over tubing as in the last method. The shoulders 34, 35 of the hex members 30 are then preferably orbitally welded to the tubing segments to complete the misting manifold 40. Again, it is preferable that tubing 39 be used that has equivalent heat capacity if the heated area of the shoulder(s) 34, 35. The emitters 99 are placed in the branch channels 37 prior to use and the then the misting manifold 40 is placed.

Figure 8:
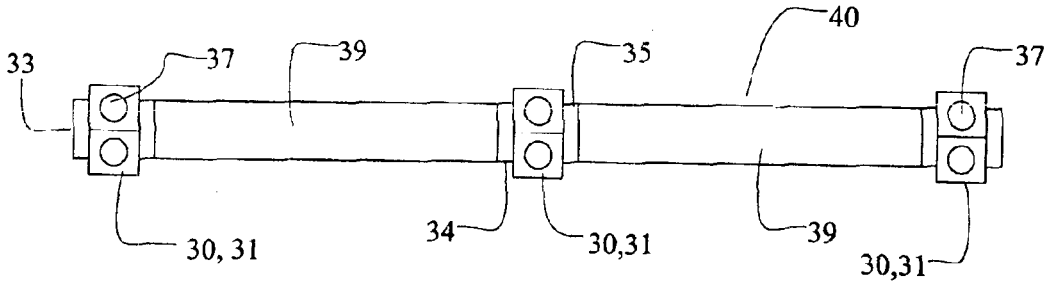
FIG. 8 is a plan view of a misting manifold of yet another construction, made from intermediate hex members having their shoulders abutted to lengths of tubing of equivalent diameter.

FIG. 8 is a schematic view of a misting manifold 40 of yet another construction, made from hex members 31 having their shoulders 34, 35 abutted to lengths of tubing 39 of equal outside diameter. As in the last embodiment this misting manifold 40 is made from hex members 31 and lengths of tubing 39, but in this embodiment by abutting the tubing 39 to the shoulders 34 and 35. This may be achieved by partially using tubing segments 39 that have the same inside and outside diameters as adjoining shoulders 34 and 35. Again, it is preferable that the tubing segments 39 that have a heat capacity equivalent to the adjoining shoulders The hex members 30 are joined with the tubing 39 by selecting tubing segments of desired length, rather than by sliding the hex members over tubing as in the first method. The shoulders of the hex members 31 are then preferably orbitally welded to the tubing segments to complete the misting manifold 40. The manifold 40 is placed and emitters are placed in the branch channels prior to use.

Figure 9A:
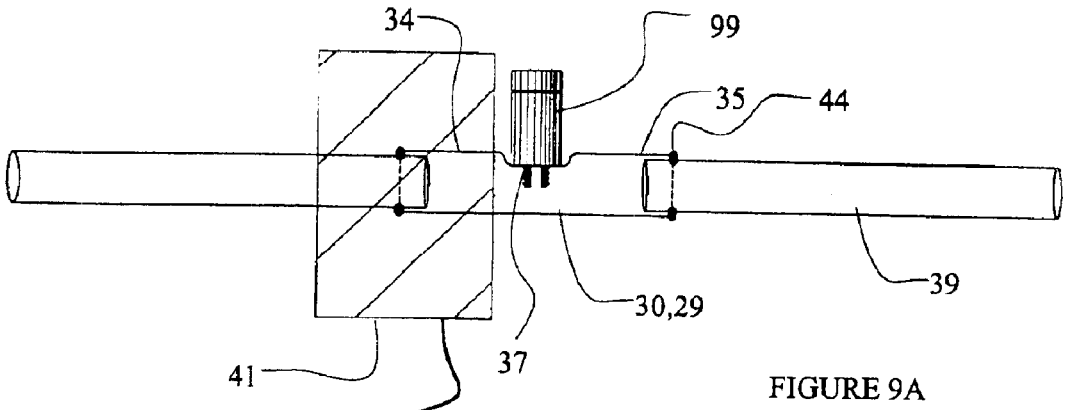
FIGS. 9A–C are a side and plan views of alternative embodiments of an intermediate member of a construction of a misting manifold of the present invention.
Figure 9B:
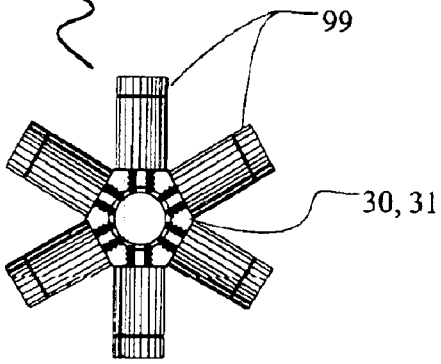
Figure 9C:
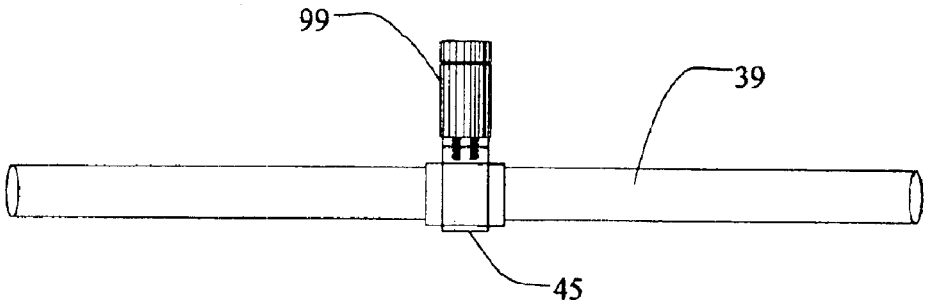

Intermediate members of other shapes may be constructed as needed. For example, FIGS. 9A–9C show the use of different intermediate members 30. A sleeve intermediate member 29 is an example of an intermediate member formed from a length of tubing, here having an outside diameter of 0.500" and an inside diameter of about 0.380". The tubing 39 used has an outside diameter of 0.370" so it may be snugly fit within the sleeve intermediate member and a fillet welded 44. Here the shoulders 34, 35 are coextensive with the length of the sleeve intermediate member 29. A face 36 is formed in a side of the sleeve intermediate member 29 by flattening (shown here) or grinding a portion of the intermediate member. A branch channel 37 is further bored in the face 36 and tapped. In this embodiment segments of tubing 39 are inserted into the sleeve intermediate member 29 and orbitally welded in place. An emitter 99 is then affixed to the branch channel 37. An orbital welder 41 is shown placed to weld tube 39 to the sleeve member 29. FIG. 9B shows a side view of the use of a hex member 31 intermediate member 30 having emitters in all six faces. FIG. 9C shows the use of a tombstone member 45 intermediate member of FIG. 3A.

Figure 10:
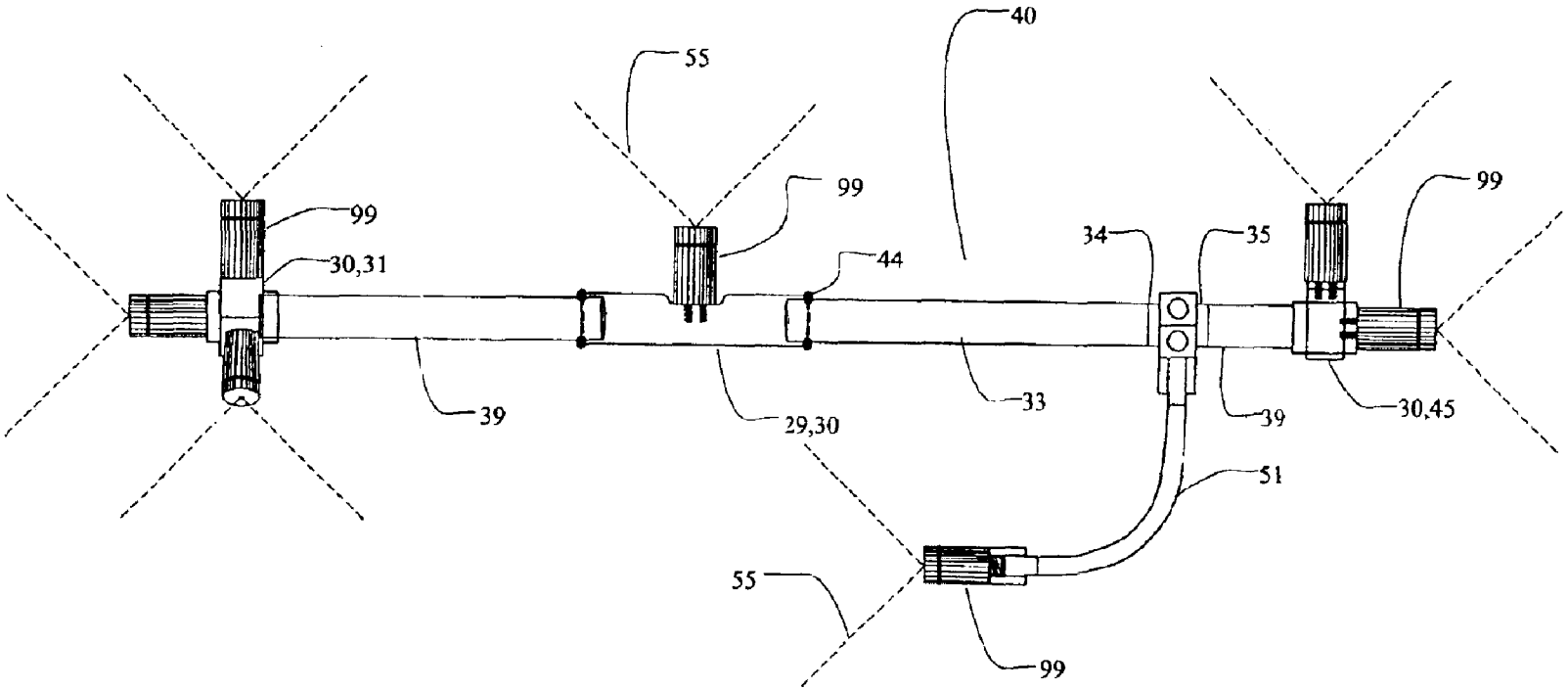
FIG. 10 is an plan view of an exemplary completed misting manifold equipped with emitters.

FIG. 10 is an schematic view of an exemplary completed misting manifold 40 equipped incorporating different types of intermediate members 30, such as hex 31, sleeve 29 and tombstone 45 intermediate members, with emitters 99, indicating the desired spray pattern 55 (shown with dotted lines). Intermediate members of different configurations may be used together in the same misting manifold. Water is introduced into the axial channel 33 of the misting manifold 40 and exits as a mist, fog or spray through the emitters 99 of misting manifold 40. An emitter extender 51 is used here as well.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention. Moreover, it will be appreciated that although the invention has been described hereabove with reference to certain examples or preferred embodiments as shown in the drawings, various additions, deletions, changes and alterations may be made to the above-described embodiments and examples without departing from the intended spirit and scope of this invention. Accordingly, it is intended that all such additions, deletions, changes and alterations be included within the scope of the following claims.

What is claimed is:

1. An intermediate member for a manifold for a misting apparatus, comprising:

an intermediate member having at least one portion with a flattened area comprising a face and an interior axial channel suitable for being welded to tubing, and a branch channel formed between the lace and the axial channel allowing liquid communication between axial channel and the face, and an emitter is attached to the branch channel.

2. The intermediate member of claim 1 further including at least one or more shoulders suitable for being welded to tubing, wherein the one or more shoulders further form the axial channel.

3. The intermediate member of claim 2 wherein the one or more shoulders are suitable for being orbitally welded to tubing.

4. The intermediate member of claim 1 wherein the intermediate member has a plurality of faces.

5. A manifold for misting apparatus, comprising:

a plurality of a intermediate members connected with tubing to allow liquid communication, the intermediate members each having a portion with a flattened area comprising a face and one or more shoulder portions and the portion with a face and the one or more shoulders forming an axial channel, a branch channel formed between the face and the axial channel allowing liquid communication between the axial channel and the branch channel and an emitter is attached to the branch channel.

6. The manifold for misting apparatus of claim 5, wherein at least one of the intermediate members is joined to the tubing at two or more shoulders to form an axial channel through the intermediate member to allow liquid communication between the tubing joined at the two or more shoulders through the axial channel.

7. The manifold for misting of claim 6, wherein liquid communication through the axial channel is achieved by sliding at least one of the intermediate members over a continuous length of tubing, and liquid communication between the branch channel and the tubing is achieved by forming an opening in the tubing and aligning the opening with the branch channel.

8. The manifold for misting of claim 5 wherein one or more of the intermediate members are joined by orbitally welding segments of tubing to one or more of the intermediate members with butt joint welds.

9. The manifold of claim 5 wherein a the shoulder is orbitally welded to tubing of substantially the same heat capacity.

10. The manifold for misting of claim 5 one or more intermediate members has a plurality of faces of substantially flattened surfaces arranged parallel to the tubing.

11. The manifold for misting of claim 5 further including an emitter affixed in each branch channel.

12. The manifold for misting of claim 11 wherein at least one emitter includes a flexible extender.

13. A method for manufacturing a misting manifold, comprising the steps of:

a) forming one or more intermediate members, each from a single billet having at least one face suitable for receiving an emitter, an axial channel suitable for being welded to tubing, a branch channel formed between the face and the axial channel allowing liquid communication between axial channel and the face, and one or more shoulders suitable for being welded to tubing, wherein the one or more shoulders further form the axial channel.

b) joining the intermediate member to tubing at the shoulder on at least one side to allow liquid communication between the branch channel of each intermediate member to the axial channel of the tubing.

14. The method for manufacturing a misting manifold of claim 13, further including the step of joining a plurality of intermediate members to the tubing so that at least one of the intermediate members is joined to the tubing at shoulders on both sides of the axial channel to allow liquid communication between the tubing and that axial channel.

15. The method for manufacturing g misting manifold of claim 13 wherein the intermediate members are joined to the tubing by the further step of sliding the plurality of intermediate members over a continuous length of tubing and welding the intermediate member to the tubing by orbital welding.

16. The method for manufacturing a misting manifold of claim 13 wherein the intermediate members are joined to the tubing by the further step of orbitally welding segments of tubing between the intermediate members with butt joint welds.

17. The method for manufacturing a misting manifold of claim 13 wherein one more shoulders are of substantially the same heat capacity as that of the immediately adjoined tubing.

18. The method for manufacturing a misting manifold of claim 13 wherein the face is a substantially flattened surface formed on the intermediate member.

19. The method for a manufacturing misting manifold of claim 18 wherein the substantially flattened face is parallel to the tubing.

20. The method for manufacturing a misting manifold of claim 19 wherein an intermediate member has a plurality of substantially flattened faces that are parallel to the tubing.

* * * * *